United States Patent [19]

Clark et al.

[11] 4,026,046

[45] May 31, 1977

[54] DANCING SLIPPER WITH SELF-MOLDING TOE INSERT

[76] Inventors: Ann V. Clark, 816 Elm St., Fayetteville, N.C. 28303; Frank A. Cannavo, Federal Bldg. (301 Green), Fayetteville, N.C. 28301; Donald L. Cannon, 125 N. Main St., Hope Mills, N.C. 28348

[22] Filed: July 29, 1976

[21] Appl. No.: 709,851

[52] U.S. Cl. ..... 36/113; 12/142 R

[51] Int. Cl.[2] ..... A43B 3/00

[58] Field of Search ..... 36/113, 114, 71 R, 93; 12/142 R, 142 P

[56] References Cited

UNITED STATES PATENTS

| | | | |
|---|---|---|---|
| 1,525,848 | 2/1925 | Bonaventure | 36/113 |
| 1,717,659 | 6/1929 | Bunnell | 36/113 |
| 1,744,122 | 1/1930 | Keeling | 36/113 |
| 1,996,083 | 4/1935 | Smith | 36/113 |
| 2,810,214 | 10/1957 | Wolfe | 36/113 |
| 3,797,137 | 3/1974 | Harkness | 36/113 |

*Primary Examiner*—Alfred R. Guest
*Attorney, Agent, or Firm*—Lawrence J. Winter

[57] ABSTRACT

A dancing slipper which is made of a relatively rigid skeleton frame having an opening in the toe portion thereof and provided with a moldable insert member which is pliable and soft when mildly heated to a predetermined temperature so as to conform to the toe configuration of the wearer or ballerina or person using this shoe and which insert may be readily removable for replacement and for remolding purposes.

10 Claims, 4 Drawing Figures

DANCING SLIPPER WITH SELF-MOLDING TOE INSERT

The present invention relates to a shoe or dancing slipper having a removable toe insert that may be tailored to the individual toe configuration of the wearer without the necessity for tailoring the entire shoe or slipper to the foot configuration of the wearer.

It is another object of the present invention to provide an economical method of providing a dancing slipper which may be mass produced with a removable toe insert that may be moldable to conform to the individual toe configuration of the dancer so as to be custom tailored thereto.

It is yet another object of the present invention to provide a moldable toe insert for a dancing shoe that the ballerina or person using the shoe will have his weight evenly distributed on the toe portion thereof, and not on the main toe as commonly occurred heretofore so as to eliminate severe strains to the dancer's foot and unnecessarily tiring thereof.

It has been recognized that it is desirable to have a dancing shoe which conforms to the user's foot when strains are being applied thereto. Foot strains occur during exercising and performing.

There is need for a shoe which will better support the foot being of such a size that the user's foot and toes will not slide or be held too tightly at any portion of the shoe. Unfortunately, there are only a limited number of different sizes of footwear corresponding to standard lengths and standard widths, and two people who have the same "size" foot do not necessarily have similarly shaped feet. With ordinary footwear, this difference is usually not crucial unless there is an abnormality in the foot. However, these small foot differences are magnified when forces during dancing are applied to the foot and shoe.

There have been numerous attempts to provide footwear that better conforms to the wearer's foot. In the field of shoe manufacturing, these attempts have generally taken several directions.

The first method is to have a shoe of soft material with adjustable buckles so that the tightness of the shoe can be modified. This is an older method and it is similar to that employed in ordinary footwear wherein the laces may be adjusted to make the shoe more comfortable to the user. This method has drawbacks because the laces do not cover the entire foot but merely serve to tighten the shoe about the instep. Also, the soft material, needed to assure that the shoe can be laced tightly, may not provide sufficient support to the foot.

The second method of improving the fit of a shoe is to provide an expandable material between the inside of it and the user's foot. In that system, the internal portion of the shoe may be fitted with a bladder which can be filled with air to have the bladder apply pressure to the foot and prevent movement within the shoe. Another method on the same principle is to have a moldable foamed plastic injected within the shoe when the user's foot is therewithin, then allowing the material to expand, cool, and reach its hardened temperature. These methods are improvements over the buckle and lace methods of having the shoe formed to the foot, however, these methods also have some drawbacks. The use of foam plastics requires that the user remain fairly stationary within the shoe for upwards of one-half hour while the material cures. This is time consuming and uses up valuable time of sales personnel selling the shoe. Also, the rather hot foamed plastic that is injected within the shoe is uncomfortable to the user. Changes in the user's foot, for example from gaining weight, injury, or the like cannot be compensated for because the foam injection alters the shoe permanently. The air bladder method has the drawback that the air cannot completely cushion the foot from the violent moves in dancing. Also, the air bladder is somewhat cumbersome to fill each time the shoe is to be used.

A third method of improving the fit of a shoe is to provide an inner boot, inside the outer shell, which holds a jelly like material which conforms to the wearer's foot when pressure is placed against it. This flow material is generally placed in the inner boot at the point of manufacture. The drawbacks of the flow system are that the flow is subject to compression after prolonged use which results in a poorer fit, and conformation of the flow to the wearer's foot causes variable thicknesses of flow material which separates the foot from the outer shell, further causing pressure points on the foot.

In accordance with the present invention, these prior difficulties have been eliminated and a very simple and facile method and apparatus for molding a dancing shoe has been provided in which the dancing shoe has a readily moldable toe insert and in which the main body portion of the shoe is provided with an opening or toe portion therein in which the moldable toe insert may be readily inserted after being heated to conform to the exact toe configuration of the proposed wearer or dancer.

Also, it may be pointed out that the shoe may be readily massed produced as any standard size shoe with only the toe portion being the part thereof that is necessary to be deformable into the particular toe configuration of the wearer.

Various other objects and advantages of the present invention will be readily apparent from the following detailed description and the accompanying drawings forming a part thereof and in which.

Figure 3:
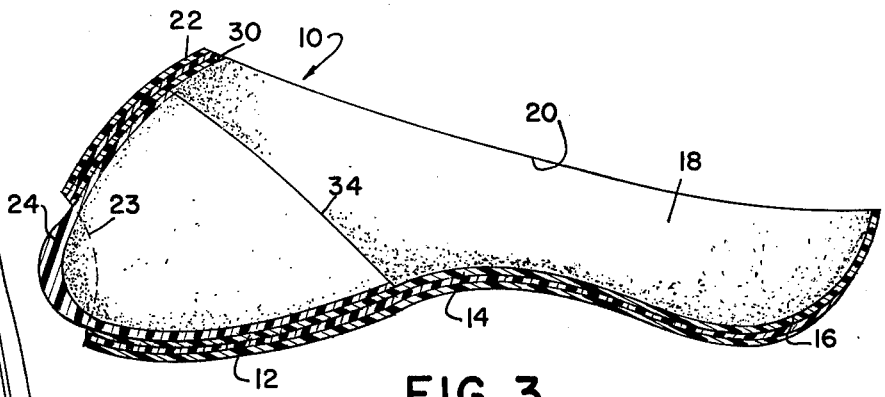
FIG. 3 is a vertical side view of the shoe with the removable toe insert disposed therein.
Figure 4:
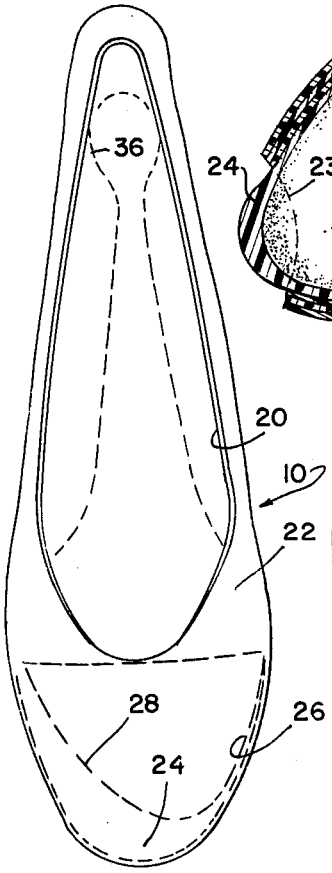
FIG. 4 is a top plan view of the shoe shown in FIG. 3.

Referring to the drawings the reference numeral 10 generally designates the dancing shoe embodied in the present invention and comprises a front portion 12 with an arched middle portion 14 and a heel portion 16 with the sides and rear portion extending upwardly so as to form a foot opening 20 therein, as best seen in FIG. 4. The foot opening 20 does not extend the full length of the shoe but only to a portion adjacent the top portion 22 of the shoe which receives the toes of the wearer. The portion 22 is open at the front across the width of the shoe as indicated at 23 in dotted lines in FIG. 3 to receive therein a self molding toe insert member 24.

The self-molding toe insert member is made of ethane vinyl acetate which becomes self-molding or pliable to conform to the toe configuration of the dancer's toes after being treated with water approximately at a boiling temperature for approximately one minute.

Figure 1:
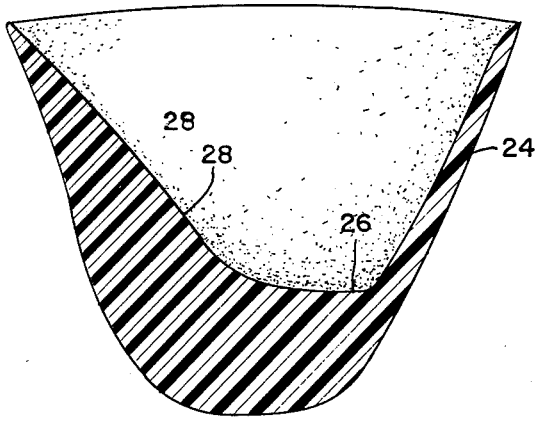
FIG. 1 is a vertical sectional view of the removable toe insert embodied in the present invention.
Figure 2:
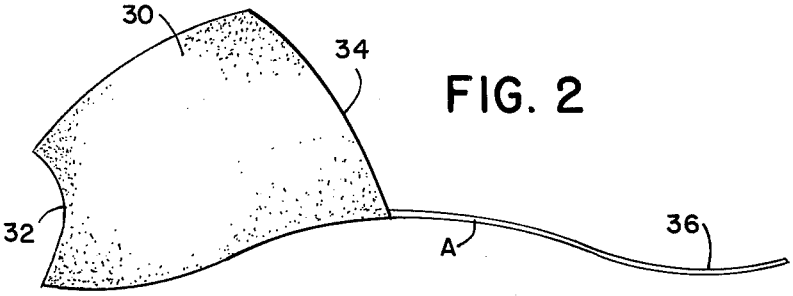
FIG. 2 is a side elevational view of the skeleton of the shoe having an opening therein for insertion of the toe insert of FIG. 1.

The toe insert 24 has a configuration, as best seen in FIG. 1 in which the toe insert is made for a right shoe, when rotated 180° becomes the left shoe, and has a concavity therein which is approximately flat on its left side as indicated at 26 to receive contact with the dancer's big toe. Thereafter it will be noted that the flat configuration 26 tapers upwardly as indicated at 28 at approximately a 45 degree angle in order to make a contact with the other toes of the dancer. Thus, the ethylene vinyl acetate insert becomes self-molding to the dancer's toes after disposed within the body of the shoe.

The polyvinyl chloride shoe body 10 covering the skeleton 30 acts to hold shoe in place on the foot and provides a good bottom surface for dancing on most commonly encountered surfaces. An individual wearing these dancing slippers may require a small amount of cotton for the toes in order to absorb excess moisture not relieved by perforations in the dancing shoe.

Thus from the foregoing description, it is apparent that the present invention provides a dancing slipper in which a removable insertable deformable and pliable toe insert may be utilized in order to convert the shoe to the exact toe configuration of the wearer and provide a custom tailored shoe upon which the weight of all the toes are evenly distributed so as to relieve any strain on the big toe which has not been utilized heretofore. Furthermore, it is not necessary to place the entire shoe body in heated water but only the removable and detachable toe forming insert.

Inasmuch as changes may be made in the method and apparatus of the present invention, and in the location of the particular parts without departing from the scope of invention, it is not meant to limit the invention except by the scope of the following claims.

What is claimed is:

1. The method of making a dancing slipper with a removable toe insert comprising molding the main body portion from thermoplastic material to provide an opening in the toe portion thereof, and molding a toe insert member to fit in said opening, said toe insert being molded to conform to the configuration of a person's toes, said toe insert member being molded of plastic material that is readily deformable when heated in boiling water for reshaping to conform to the toe configuration of a wearer.

2. The method of claim 1 wherein said toe insert is made of ethane vinyl acetate material.

3. The method of claim 1 where said toe insert is molded as a cup shaped member with a toe cavity having relatively flat deep bottom portion on one side with a contiguous portion tapering upwardly to the top edge of the toe insert.

4. The method of claim 3 wherein said body portion is molded of polyvinylchloride and polyethylene plastic material.

5. A dancing slipper comprising a main skeleton body portion with a top opening to receive a foot therethrough, said shoe having an opening across the front thereof to receive the toes of the wearer, and a detachably connected toe receiving insert disposed in said body portion and projecting outwardly of said front opening.

6. The slipper of claim 5 where said front portion of said body portion is reinforced with an inner skeleton molded to said body portion.

7. The slipper of claim 6 wherein said insert is a cup shaped member conforming to the inner surface of said body portion and in contact therewith.

8. The slipper of claim 7 wherein said insert is made of a plastic material deformable when placed in boiling water.

9. The slipper of claim 8 wherein said insert has a toe cavity substantially flat deep bottom on one side and gradually tapering upwardly therefrom to provide a cavity for contact with all the toes of a person wearing said slipper.

10. The slipper of claim 9 wherein said insert is made of ethane vinyl acetate and said body and skeleton is made of polyvinyl chloride and polyethylene plastic material respectively.

* * * * *